United States Patent [19]

Williams

[11] 3,945,153

[45] Mar. 23, 1976

[54] GRINDING MACHINE WITH TILTED CONVEYOR AND CONVEYOR CLEARING MEANS

[75] Inventor: David Godfrey Williams, Wirral, England

[73] Assignee: C.E.S. (Grinding Machines) Limited, England

[22] Filed: Apr. 19, 1974

[21] Appl. No.: 462,529

Related U.S. Application Data

[63] Continuation-in-part of Ser. No. 172,479, Aug. 17, 1971, Pat. No. 3,805,456.

[30] Foreign Application Priority Data

Aug. 28, 1970 United Kingdom ..... 41474/70

[52] U.S. Cl. ..... 51/110; 51/216 R; 198/230

[51] Int. Cl.² ..... B24B 7/02; B65G 45/00

[58] Field of Search ..... 51/109, 110, 112, 138, 51/216 R, 74 R; 198/41, 230

[56] References Cited

UNITED STATES PATENTS

| | | | |
|---|---|---|---|
| 1,995,382 | 3/1935 | Fenton | 51/138 |
| 2,586,848 | 2/1952 | Miller | 51/141 |
| 2,600,056 | 6/1952 | Jones | 198/230 |
| 2,633,677 | 4/1953 | Lowe | 51/112 X |
| 3,019,564 | 2/1962 | Haracz | 51/110 X |
| 3,805,456 | 4/1974 | Williams | 51/110 X |

*Primary Examiner*—Al Lawrence Smith
*Assistant Examiner*—Nicholas P. Godici
*Attorney, Agent, or Firm*—Steinberg & Blake

[57] ABSTRACT

A machine which has an endless conveyer belt for conveying workpieces past a work station where operations such as, for example, grinding operations are performed on the workpieces. Thus this conveyer belt has upper and lower runs and a support extends between these upper and lower runs and has an upper surface engaging a lower surface of the upper run of the conveyor belt to support this upper run for sliding movement. A part of the upper surface of the support, which engages the lower surface of the upper run of the belt, includes structure for cleaning the conveyor belt at the lower surface of its upper run so as to avoid any possible undesired separation of the upper run of the endless belt from the upper surface of the support.

9 Claims, 4 Drawing Figures

—FIG. 2.—

GRINDING MACHINE WITH TILTED CONVEYOR AND CONVEYOR CLEARING MEANS

CROSS REFERENCE TO RELATED APPLICATION

The present application is a continuation-in-part of copending application Ser. No. 172,479, filed Aug. 17, 1971, U.S. Pat. No. 3,805,456 and entitled GRINDING MACHINE.

BACKGROUND OF THE INVENTION

The present invention relates to machines of the type which include an endless conveyor belt having an upper run sliding on a support surface.

Such structure may be included in a grinding machine, and the present invention is particularly applicable to grinding machines.

In certain types of machine tools, where workpieces are conveyed by a run of a conveyor belt which slides along a supporting surface, it is important to prevent any undesired separation of the belt from the supporting surface along which it slides. Such undesired separation can be caused, for example, by particulate matter which undesirably becomes located between the belt and the support surface on which it slides, or such undesired separation may be caused by excess fluid which becomes situated between the belt and the surface on which the belt is intended to slide. Of course, in the case of particulate matter, undesired scratching of the surface on which the belt slides can occur. However, this undesired separation of the belt from its supporting surface is a possible source of inaccuracy in the machine operations. For example if the machine tool which acts on the workpieces is situated over the belt so that the workpieces move between the belt and the machine tool while conveyed by the belt, the distance between the belt and the machine tool is critical in order to obtain desired accuracy in the machining of the workpieces. Thus, if the machine tool is a rotary grinding wheel having a downwardly directed grinding surface located over the upper surface of the belt which carries the workpieces, if this upper surface does not reliably engage the supporting surface beneath the belt, the belt will be displaced by particulate matter, excess fluid, or the like, closer to the grinding wheel or other machine tool, so that inaccuracies will occur in the machining operations in that the particulate matter, excess fluid, or the like locates the belt and thus the workpieces carried thereby closer to the grinding wheel or the like than would be the case if the undesired separation between the belt and the surface on which it slides did not occur. As a result too much material is cut away from the workpieces during the machining thereof as a result of the location of undesired matter between the belt and the surface on which it slides.

This problem has already been recognized in the art. In order to avoid the drawbacks resulting from undesired separation of the belt from the surface on which it is intended to slide it has already been proposed to wash the surface of the endless conveyor which slidably engages the support with water jets, and it has also been proposed to provide rubber scraper blades which act to dislodge waste material from the conveyor so as to minimize in this way the possibility of inaccuracies in the machining operations such as grinding, for example.

However, these attempted solutions to the problem have not proved to be fully satisfactory in practice. The use of jets of water or the like or rubber scraper blades undesirably complicate the machine tool and such expedients in themselves create undesired problems. Furthermore, because the cleaning operations achieved with such water jets, scraper blades, or the like, take place at a location other than the surface on which the belt slides, it is still possible for undesired matter to become located between the belt and the surface on which it slides prior to cleaning of this matter away from the belt, so that the known attempts to solve the problem cannot be fully relied upon to achieve the desired results.

SUMMARY OF THE INVENTION

It is accordingly a primary object of the present invention to provide a machine with a construction which will avoid the above drawbacks.

In particular it is an object of the present invention to provide a machine which is capable of reliably maintaining a conveyor belt in engagement with a surface on which the belt slides so that inaccuracies in the machining operations cannot occur.

In particular it is an object of the present invention to provide a structure of the above type which will effect the desired cleaning away of extraneous matter at the location where the belt engages the surface on which it slides, so that it will not be possible for even a small amount of undesired matter to become situated between the belt and the surface on which it slides.

Furthermore it is an object of the present invention to achieve the above objects with a construction which is exceedingly simple, inexpensive, and highly reliable.

It is in particular an object of the present invention to provide a structure which will achieve the above objects in a grinding machine.

According to the invention the machine has an endless conveyor belt provided with upper and lower runs between which a support extends with the support having an upper surface engaging the lower surface of the upper run of the belt so as to support this upper run for sliding movement along the upper surface of the support. A part of this upper surface of the support has a means for cleaning the lower surface of the upper run of the belt so that undesired separation of the upper run of the belt from the upper surface of the support will be reliably avoided. Preferably, the means for cleaning the lower surface of the upper run of the endless conveyer belt takes the form of a part of the support, at the upper surface thereof, which is formed with a groove extending transversely across the belt so that any desired matter at the lower surface of the upper run of the belt will be received in this groove to prevent undesired separation of the belt from the surface on which it slides. The cleaning means will preferably comprise a plurality of passages defined in the support surface and preferably at least in the region of the work station. The passages will preferably intersect each other and will normally be in the form of straight grooves or channels. The inclination of the passages is such as to cause material received in the passage to be displaced therealong by the action of the lower surface of the conveyer belt and to be eventually discharged at the ends thereof.

In a preferred embodiment of the grinding machine and at least in a region beneath the annular grinding surface remote from the work station, the plane in which the support base surface lies and the axis of rotation of the rotary means intersect at an angle other than ninety degrees such that the portion of the support surface in the work station region is closer to the grinding wheel than the portion of the support surface remote therefrom.

BRIEF DESCRIPTION OF DRAWINGS

The invention will be described further, by way of example, with reference to the accompanying drawings, in which.

DESCRIPTION OF PREFERRED EMBODIMENTS

Figure 1:
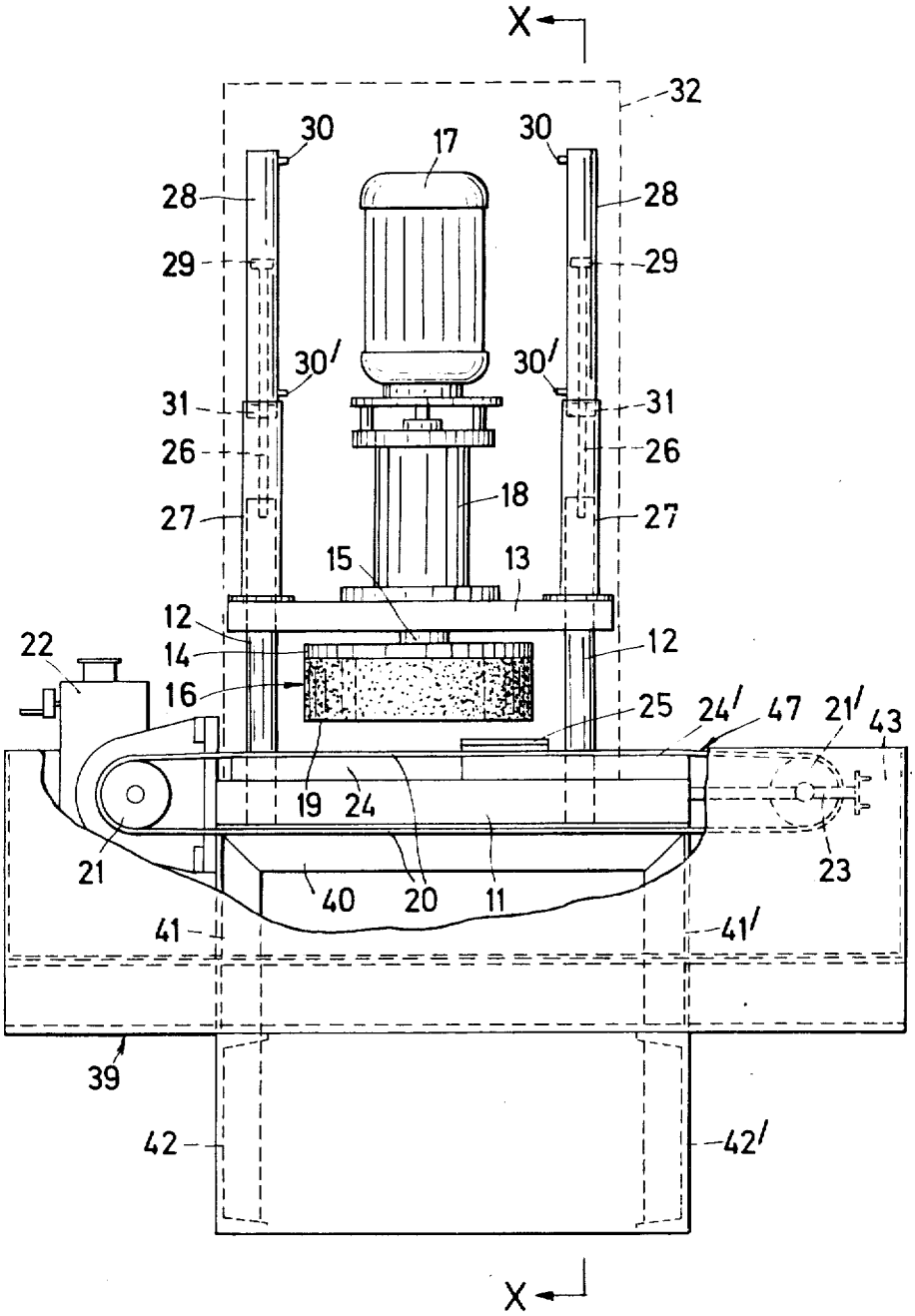
FIG. 1 is a front elevation with a cut-away portion of a grinding machine.
Figure 2:
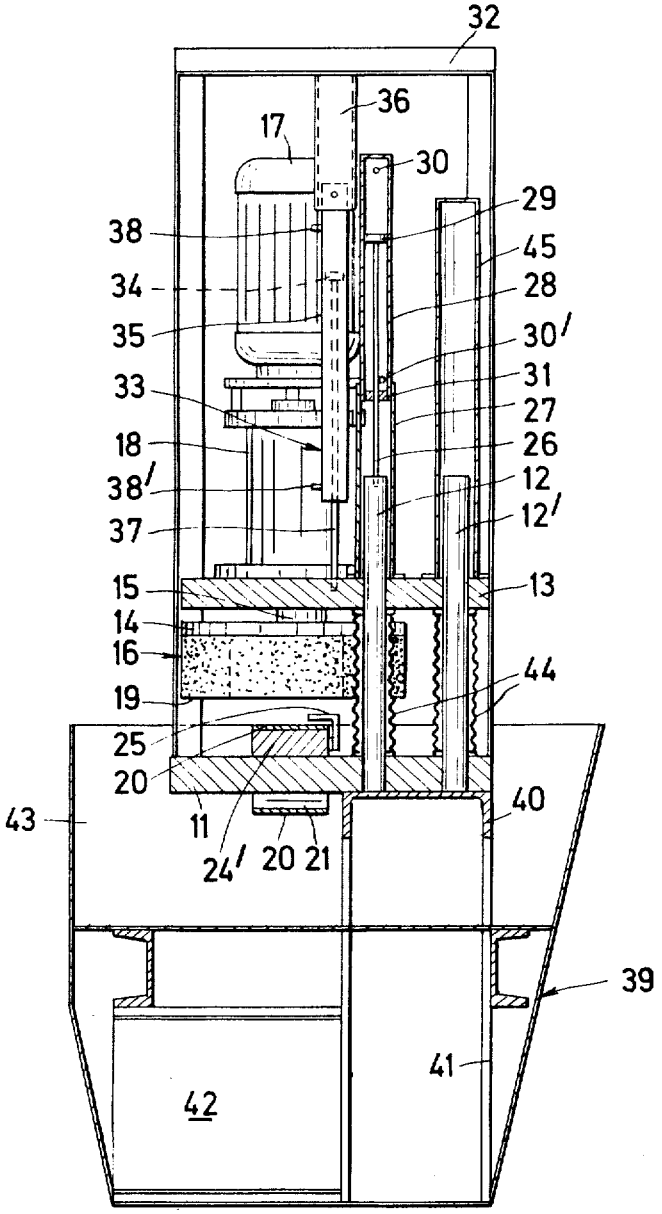
FIG. 2 is a section on the line X — X of FIG. 1 but including a guard and associated positioning means therefor and excluding the drive motor for a conveyer belt.

The grinding machine shown in FIGS. 1 and 2 includes a rigid, rectangular workpiece support base 11 having flat, machined faces and four rectilinear, cylindrical guide columns 12, 12' rectangularly arranged and extending substantially normally therefrom (only three of the columns in fact being shown in FIGS. 1 and 2). The four columns 12, 12' are fastened at their lower ends by force-fit in apertures in the base 11 and are arranged in pairs evenly spaced about the transverse axis of the base 11. The columns 12, 12' are located to one and the same side of the longitudinal axis of the base 11.

A rectangular head 13 is displaceably mounted on columns 12, 12' which pass through apertures therein. Preloaded linear ball bushes (not shown) are provided in the aperatures as bearings to ensure accurate and smooth displacement of the head 13 on the columns.

A circular plate 14 and a shaft 15 connected thereto and rotatably mounted in bearings (not shown) on the head 13 form rotatable support means for carrying a hollow grinding wheel 16. An electric motor 17 with bearing housing 18 is mounted on the head 13 and rotates grinding wheel 16 via shaft 15 and plate 14.

Figure 3:
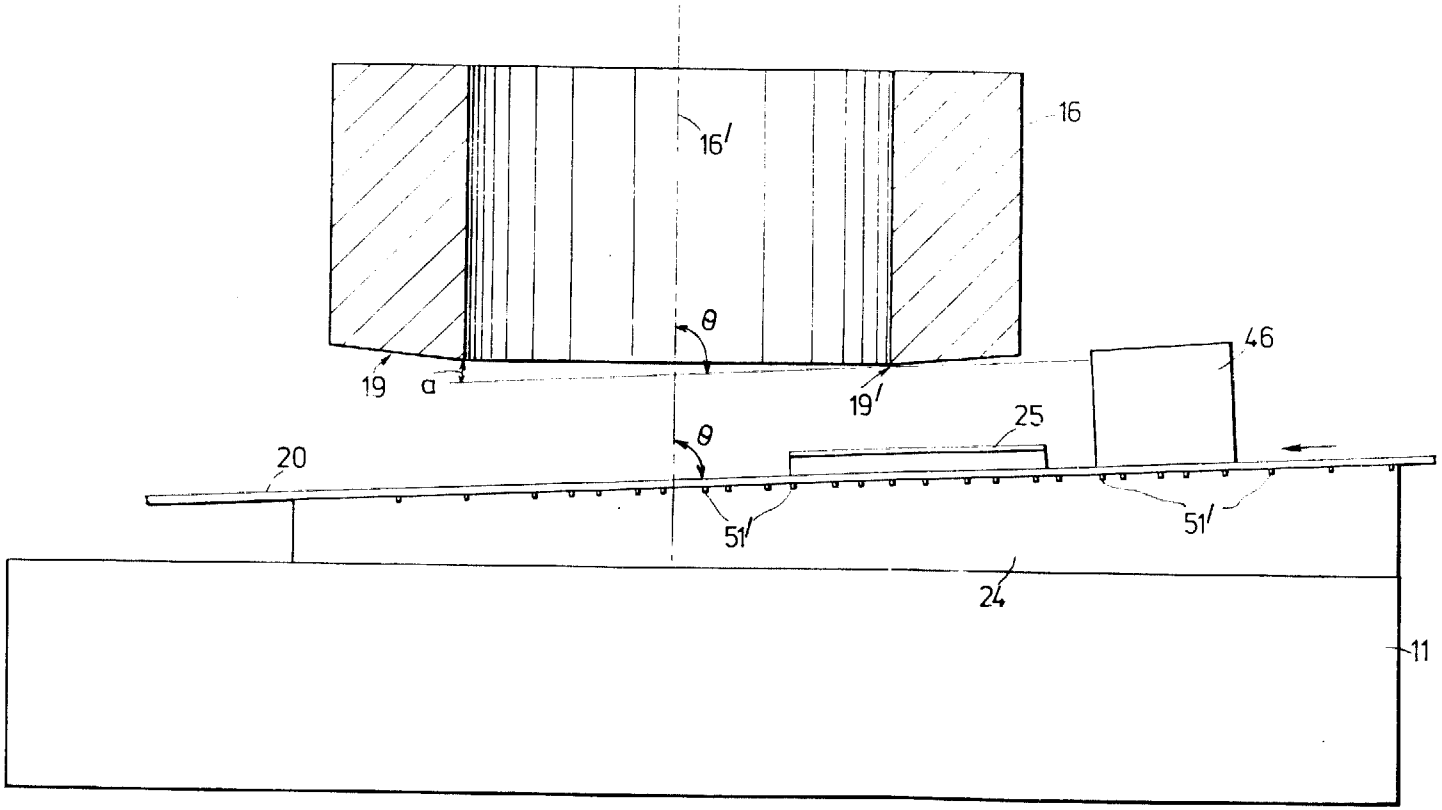
FIG. 3 is an enlarged schematic elevation of the base means and grinding means showing features thereof in exaggerated form and showing the ends of material receiving grooves formed in the magnetic clutch.

The grinding wheel 16 is secured, in known manner, to the plate 14 by a plurality of screws extending through aperatures in plate 14. The wheel 16 is supported by the plate 14 and shaft 15 so as to be rotatable about an axis which is also substantially normal to the base 11. The annular cutting face 19 of the grinding wheel 16 is cut-slanting or throated to give a uniform rate of cut of workpieces and this tapered throat dictates the maximum out of the wheel. The slanting face is not of sufficiently appreciable dimension to be shown in FIGS. 1 and 2 but is shown in FIG. 3 which is not to scale and wherein certain features are exaggerated. The slanting face extends from the outer peripheral edge of the wheel downwardly to the inner edge of the wheel.

A continuous conveyer belt 20 made of phosphor bronze is carried by two pulleys 21 and 21' of which pulley 21 is mounted on base 11 and driven by a variable speed electric motor 22. Pulley 21' is adjustably mounted on base 11 by a screw belt-tensioning device 24 which enables the belt tension to be adjusted and also the belt to be readily removed from the pulleys. The conveyer belt 20 extends substantially parallel to the front edge of base 11 and around the base 11. The belt 20 is slidably displaceable over two longitudinally extending magnetic chucks 24, 24' securely located on the base 11 and extending substantially parallel with the base 11 and substantially diametrically with respect to the wheel 16.

A guide stop 25 of substantially inverted L-shape section is removably secured to the magnetic chuck 24' in the cutting region of the wheel 16 and serves to retain workpieces on the belt during grinding operations. Workpieces slide along the guide stop 25 during grinding. The guide stop 25 extends over and is parallel with the belt 20 and is suitably dimensioned for particular grinding operations so as to substantially avoid contact with the wheel 16 after a workpiece has been ground thereby.

Each of the two columns 12 has a piston rod 26 secured thereto and extending upwardly therefrom and through a "top-hat" arrangement or flanged sleeve 27 extending around the top portion of each column 12. Each sleeve 27 is bolted at its lower end to the head 13 by means of its flange, and is fastened at its other end to a hydraulic cylinder 28 which slides over a double acting piston 29 carried by piston rod 26. The cylinders 28 each have upper and lower hydraulic flow ducts 30 and 30' communicating with a hydraulic liquid source and control system (not shown). The cylinders 28 each have a closed lower end 31 having a seal which slides along each piston rod 26. It will be appreciated that the sleeves 27 act to transmit a displacing force to the head 13 from the piston-cylinder unit 26, 28, 29.

The hydraulic liquid control system (not shown) supplies equal quantities of liquid to respective chambers of each cylinder 28 and includes hydraulic locks which prevent the flow of liquid into or out of the upper and lower chambers of cylinders 28 when the grinding wheel has been located in a required position. Accordingly, the head 13 is adjustably locatable on the guide columns 12, 12'. Further, an air sensor (not shown) acts on the cutting face of the wheel 16 and is associated with a metering device of the hydraulic grinding wheel 16, so that lowering of the head and wheel by an amount corresponding to the wheel wear is effected by releasing a suitable amount of hydraulic liquid from the upper chambers of cylinders 28. A pressure accumulator is provided in the hydraulic system to avoid having the hydraulic pump running whilst minor displacements of the head are being effected during grinding.

A guard 32, indicated in dotted line only in FIG. 1, is provided for enclosing the grinding area and is in the form of a rigid, enclosed box frame which is open at its top and bottom ends. The guard 32 is displaceably mounted on the head 13 by means of two hydraulic piston-cylinder units 33 which have been omitted from FIG. 1 for the sake of clarity. The piston-cylinder units, of which only one is shown in FIG. 2, are not located in line with columns 12, 12' (i.e. not on line X — X) but rather inwardly thereof and on the longitudinal axis of the head 13, one either side of the transverse axis of the head 13.

The piston 34 of the piston-cylinder unit 33 is also double acting and slidable in cylinder 35 which is connected to a frame member 36 connected to the framework of guard 32. Piston rods 37 each carry a piston 34 and are connected to the head 13. The cylinder 35 is provided with hydraulic liquid flow ducts 38 and 38' which communicate with the hydraulic control system of the machine so that the guard is displaceable on the head 13 and may be locked in position by piston-cylinder units so as to bear on the base 13 during grinding and as shown in FIG. 2.

The guard 32 is provided with suitable inlet and outlet apertures (not shown) in opposite side walls to permit traversing of workpieces on the belt 20 under the grinding wheel 16.

The base 11 is supported by a mounting generally indicated by arrow 39 and is bolted (not shown) to horizontal frame member 40 to overhang as a cantilever. The frame member 40 is rigidly connected to vertical frame members 41, 41' which in turn are connected to further horizontal frame members 42, 42' acting as feet for the mounting and providing stability therefor. The casing of the mounting 39 forms a trough 43 for collecting grinding fluid, etc., during grinding operations.

Liquid removal means (not shown) are provided to prevent over-filling of the trough 43. Washing devices (not shown) are also provided to clean the belt 20 and means (also not shown) are provided to prevent contamination of the underside of the belt and the surfaces of the chucks. Also, gaiters 44 are provided on the columns 12, 12' to prevent contamination and damage to the machined surfaces thereof and of the bearings therefor. The two columns 12' (only one being shown in FIG. 2) are each provided with a covering sleeve 45 mounted on head 13 and extending upwardly therefrom to terminate in a closed end. The sleeves 45 serve to protect columns 12' from contamination and act as supporting means for control devices of the machine.

The cantilever mounting of base 11 on the frame member 40 permits free movement of the belt around the base and, together with the location of the columns 12, 12', to one side of the conveyor belt 21 and chucks 24, 24' also permits a belt to be readily removed from the pulleys 21, 21' and replaced by another. The location of the columns 12, 12' also provides good access to both the grinding wheel and conveyor belt and clearance for workpieces. The guard 32 is raised off the base 11 when the wheel or belt is being changed. It is to be noted from the drawings, that the pulleys 21, 21' are arranged so as to urge the belt 20 against the upper surfaces of the magnetic chucks 24, 24'.

The belt 20 of the machine rotates in an anti-clockwise direction as viewed in FIG. 1 and the wheel 16 also rotates in anti-clockwise direction as viewed from above. The relative belt and wheel displacement is illustrated in the schematic plan view in FIG. 4. Workpieces 46 are fed onto the belt 20 in line with guide-stop 25 and acted upon by the wheel 16 adjacent guide stop 25 which prevents dislodgement of the workpieces from the belt. It should be noted that ferromagnetic workpieces may be ground by the machine. Suitable control means (not shown) for the drive motors 17 and 22 and the hydraulic system, and gauges for sizing the workpieces are provided.

An automatic feed means or station may be provided in region 47 and may comprise any suitable device such as an upwardly extending stop member transverse to the belt and adjustably displaceable above the belt such that a stack of workpieces to be ground may be held thereby but spaced from the belt to permit workpieces to be withdrawn thereby.

In FIG. 3, the slant of the annular cutting face 19 of the wheel 16 is visually discernable since it is shown in exaggerated form. The magnetic chuck 24, which with the base 11 forms the base means, has an upper support surface in which a plurality of intersecting channels or grooves 51 are formed the ends 51' of the grooves being shown in FIG. 3.

The top surface of chuck 24 is arranged so that it is inclined relative to base 11 and lies in a plane which is inclined at an angle $\theta$ relative to the axis of rotation 16' of the grinding wheel 16. The relative disposition of the chuck face and axis of rotation is such as to provide a clearance $a$ from the ground surfaces of workpieces which are conveyed on a belt 20 which slides over the surface of chuck 20. The work station of the grinding machine shown terminates at the region 19' which, relatively speaking, is the lowermost point of the wheel, i.e. the point closest to the chuck 24. It is to be appreciated that the angle $\theta$ is very close to ninety degrees since a clearance $a$ of only several thousandths of an inch is required. The relative disposition of the support surface (support base) of the magnetic chuck 24 and consequently of the support run of the conveyor belt, to the axis of rotation of the grinding wheel constitutes clearance forming means.

Figure 4:
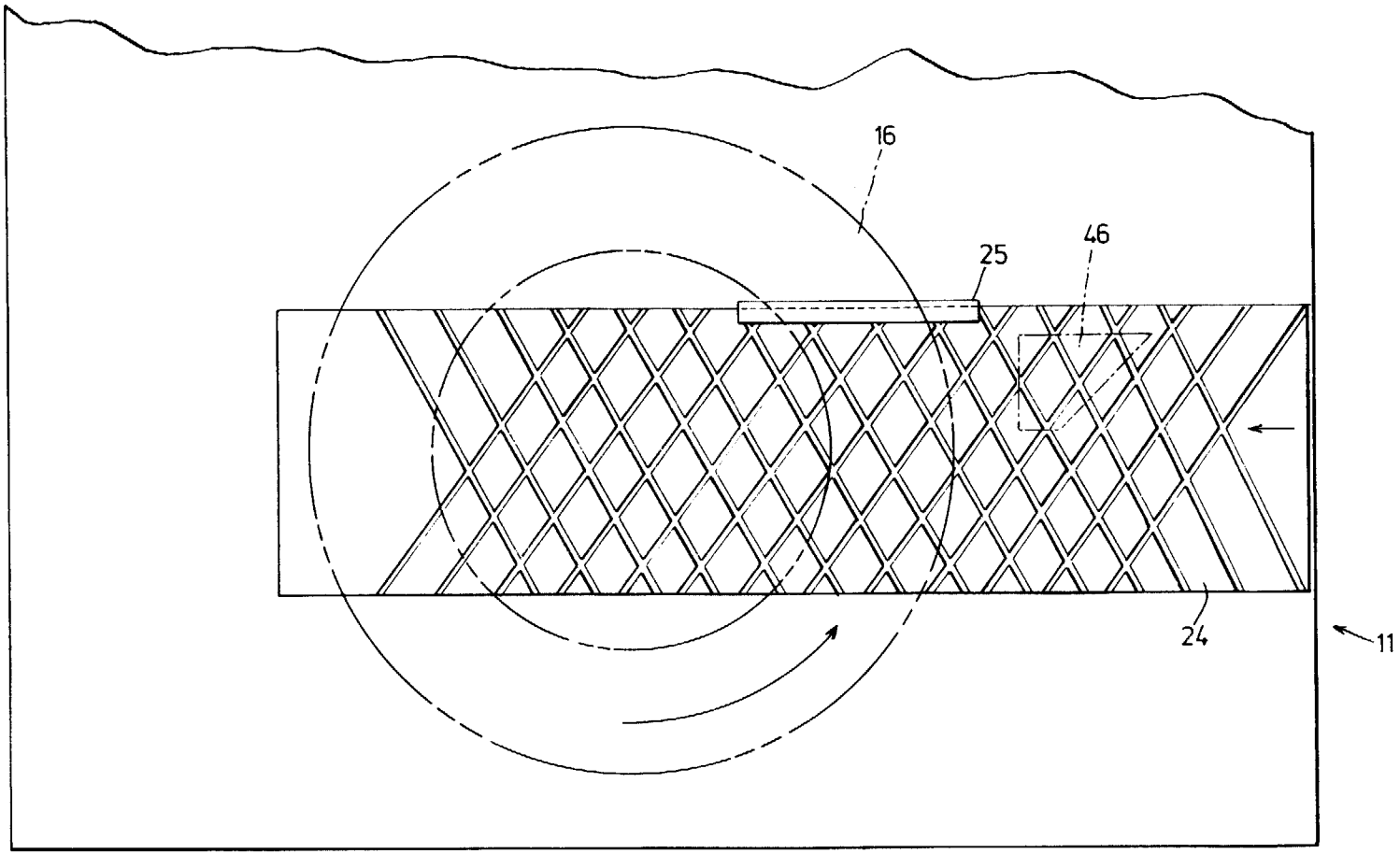
FIG. 4 is a schematic plan view of the base means of the machine of FIG. 3.

The intersecting grooves 51 are more clearly shown in FIG. 4. The grooves 51 are arranged so as to be inclined relative to the normal direction of travel of the conveyor belt 20 (not shown in FIG. 4); said direction being indicated by the arrow in the right-hand side of the drawing. The grooves 51 are preferably disposed at least in the region of the work station since in such region the belt is pressed against the support surface of the chuck which further encourages extraneous material to be scraped or urged into the grooves. The inclination of the grooves relative to the direction of movement of the belt is such as to cause material forced into the grooves to be displaced therealong and subsequently discharged from the ends thereof.

The grooves 51, formed in the surface of the chuck 24 which forms the datum grinding face, are shown extending diagonally in criss-cross arrangement. The grooves will be of such width as not to cause the workpieces to be irregularly seated during grinding and would normally be approximately 1/16th inch wide and ⅛th inch deep. The side walls of the grooves extend at ninety degrees to the top surface of the chuck.

I claim:

1. In a machine which includes an endless conveyer belt having upper and lower runs, and a support extending between said upper and lower runs and having an upper surface engaging a lower surface of said upper run to support the latter for sliding movement along said upper surface of said support, and means situated at said upper surface of said support for cleaning the lower surface of said upper run of said belt and for preventing undesired separation of said lower surface of said upper run from said upper surface of said support, the machine being a grinding machine and including a rotary grinding wheel situated over said upper run of said belt for grinding workpieces conveyed by said belt past said grinding wheel between said upper run of said belt and said grinding wheel, said grinding wheel having a lower tapered grinding surface of circular configuration provided with inner and outer peripheries and situated with its inner periphery closer to said belt than at its outer periphery, said surface of said support which engages said lower surface of said upper run of said belt and said upper run of said belt therewith being inclined at least slightly with respect to the axis of the grinding wheel, at an angle other than a right angle, for conveying the workpieces downwardly with respect to the grinding wheel so that when the grinding is completed at one side of the inner periphery of the grinding wheel the workpieces will clear the grinding wheel at an opposite side of the inner periphery thereof.

2. The combination of claim 1 and wherein said means includes a part of said upper surface of said support which is formed with a groove extending across said upper run of said belt at said lower surface thereof for cleaning said lower surface of said upper run and for receiving therefrom any matter which otherwise would separate said lower surface of said upper run from said upper surface of said support.

3. The combination of claim 2 and wherein said support has at least one free edge at which said groove has an open end so that matter collecting in said groove can flow out of the latter through said open end thereof.

4. The combination of claim 2 and wherein said groove extends across said belt at an angle other than a right angle.

5. The combination of claim 4 and wherein said means includes a first set of grooves formed in said part of said support and extending in parallel relation across said belt at an angle other than a right angle and a second set of grooves inclined oppositely to said first set of grooves and intersecting the latter.

6. The combination of claim 5 and wherein said support has at least one free edge where all of said grooves have open ends through which matter collecting in said grooves can move out of the latter.

7. The combination of claim 1 and wherein said support includes a magnetic chuck engaging said lower surface of said upper run of said belt.

8. The combination of claim 7 and wherein said magnetic chuck has a lower surface with respect to which said support surface of said support which forms part of said chuck is inclined.

9. The combination of claim 1 and wherein the machine is a grinding machine and includes a stationary frame means and a base means which forms said support and is carried by said frame means, said base means having a portion fixed to said frame means and said base means extending freely in cantilever fashion beyond said frame means so as to have a free portion situated beyond said frame means, said endless conveyer belt forming an endless conveyer means extending along and around said free portion of said base means for conveying work past a work station, said endless conveyer means having on one side of said base means a work-supporting portion, column means fixed to and extending substantially normal to said base means at the portion thereof which is fixed to said frame means, support means guided by said column means for movement therealong toward and away from said base means, adjusting means operatively connected to said support means for adjusting the position of the latter along said column means, rotary grinding means having an annular grinding surface supported for rotary movement by said support means and situated between the latter and said base means with said work-supporting portion of said endless conveyer means situated between said base means and said rotary grinding means, said rotary grinding means being in alignment with said work station so that while work is moved past said work station it can be acted upon by said rotary position means, workretaining means extending along an edge of said work-supporting portion of said endless conveyor means for retaining work at the work station while the work is acted upon by the rotary grinding means, said base means being in the form of a substantially horizontal support base, said column means including at least one rectilinear support column secured at its lower end to said base and extending vertically therefrom, said support means being in the form of a carrier head formed with an opening through which said column extends, and said head also extending in cantilever fashion freely beyond said column where said head has a cantilever portion, said cantilever portion of said head being the part thereof which supports said rotary grinding means for rotary movement, and said cantilever portion of said head being aligned with the portion of said base means which extends in cantilever fashion freely beyond said frame means.

* * * * *